US009805693B2

(12) United States Patent
Amirkhany et al.

(10) Patent No.: US 9,805,693 B2
(45) Date of Patent: Oct. 31, 2017

(54) RELAY-BASED BIDIRECTIONAL DISPLAY INTERFACE

(71) Applicant: SAMSUNG DISPLAY CO., LTD., Yongin-si, Gyeonggi-Do (KR)

(72) Inventors: Amir Amirkhany, Sunnyvale, CA (US); Sanquan Song, Mountain View, CA (US)

(73) Assignee: Samsung Display Co., Ltd., Yongin-si (KR)

( * ) Notice: Subject to any disclaimer, the term of this patent is extended or adjusted under 35 U.S.C. 154(b) by 16 days.

(21) Appl. No.: 14/951,387

(22) Filed: Nov. 24, 2015

(65) Prior Publication Data

US 2016/0163291 A1 Jun. 9, 2016

Related U.S. Application Data

(60) Provisional application No. 62/087,770, filed on Dec. 4, 2014.

(51) Int. Cl.
*G09G 5/00* (2006.01)
*G09G 5/18* (2006.01)

(52) U.S. Cl.
CPC ..... *G09G 5/18* (2013.01); *G09G 2330/026* (2013.01); *G09G 2360/04* (2013.01); *G09G 2370/04* (2013.01); *G09G 2370/08* (2013.01)

(58) Field of Classification Search
CPC .. G09G 3/3275; G09G 3/3611; G09G 3/3685; G09G 3/3688; G09G 5/006; G09G 5/395; G09G 5/397; G09G 2300/0408; G09G 2300/0426; G09G 2310/0275; G09G 2310/0283; G09G 2310/0286; G02F 1/13454; H04L 25/026
See application file for complete search history.

(56) References Cited

U.S. PATENT DOCUMENTS 7,898,518 B2 * 3/2011 Hong ..... G09G 3/3611 345/100
7,936,330 B2 * 5/2011 Park ..... G09G 3/3611 345/100
7,948,465 B2 * 5/2011 Cho ..... G09G 3/006 345/100
8,325,309 B2 12/2012 Gettemy et al.
8,456,407 B2 6/2013 Weng et al.
9,536,495 B2 * 1/2017 Amirkhany ..... G09G 3/2096
(Continued)

FOREIGN PATENT DOCUMENTS

JP 2558845 B2 11/1996

OTHER PUBLICATIONS

English Abstract for Japanese Publication No. JPH02-120793 A, dated May 8, 1990.

*Primary Examiner* — Joe H Cheng
(74) *Attorney, Agent, or Firm* — Lewis Roca Rothgerber Christie LLP

(57) ABSTRACT

A chain of bidirectional display driver integrated circuits (DICs). The chain has a beginning and an end, the chain includes a plurality of DICs, each of the plurality of DICs including: a direct data input, a relay data input, and a relay data output. Each of the plurality of DICs is configured to combine data received at the direct data input with a stream of bits received at the relay data input to form combined data, and to transmit the combined data through the relay data output.

20 Claims, 8 Drawing Sheets

(56) References Cited

U.S. PATENT DOCUMENTS

| | | | | |
|---|---|---|---|---|
| 2002/0180686 | A1 | 12/2002 | Yuda et al. | |
| 2004/0125069 | A1 | 7/2004 | Park et al. | |
| 2006/0232579 | A1* | 10/2006 | Chen | G09G 3/3611 345/211 |
| 2008/0218647 | A1 | 9/2008 | Park | |
| 2008/0303767 | A1* | 12/2008 | Ludden | G09G 3/3688 345/89 |
| 2010/0148829 | A1* | 6/2010 | Hong | G09G 3/3648 327/108 |
| 2011/0157103 | A1* | 6/2011 | Chen | G09G 3/3685 345/204 |
| 2011/0242066 | A1* | 10/2011 | Jeon | G09G 3/20 345/204 |
| 2012/0096509 | A1* | 4/2012 | Zeng | H03L 7/0807 725/127 |
| 2012/0146965 | A1* | 6/2012 | Baek | G09G 3/006 345/204 |
| 2015/0103038 | A1* | 4/2015 | Han | G06F 3/044 345/174 |
| 2015/0187315 | A1* | 7/2015 | Park | G09G 3/3685 345/99 |

* cited by examiner

RELAY-BASED BIDIRECTIONAL DISPLAY INTERFACE

CROSS-REFERENCE TO RELATED APPLICATION(S)

The present application claims priority to and the benefit of U.S. Provisional Application No. 62/087,770, filed Dec. 4, 2014, entitled "A RELAY-BASED BIDIRECTIONAL DISPLAY INTERFACE", the entire content of which is incorporated herein by reference.

FIELD

One or more aspects of embodiments according to the present invention relate to data transmission, and more particularly to a system for combining multiple reverse data streams into one, in a display device.

BACKGROUND

Display devices may be constructed with a timing controller (TCON) that sends high rate (e.g., video) data to driver integrated circuits (DICs) on source boards at the display panel. In addition to the video data sent in the "forward" direction, reverse data may also be sent by the DICs to the TCON. Such reverse data may carry information, for example, from sensors (e.g., touch sensors or optical sensors) embedded in the display panel. The data rate of the reverse data may be lower than (e.g., $1/10^{th}$) that of the forward data.

The use of the individual forward links as bi-directional links, e.g., in a full-duplex or half-duplex system, may result in near end crosstalk (NEXT) for the forward link and vice versa. The use of dedicated reverse lanes (one per DIC) may result in a need to add traces, connectors, and cables to the system, and may consequently increase cost. The additional of a chip to the source board that aggregates the data from all low-speed reverse links and sends the aggregated data back to the TCON at high speed may also increase cost, and complexity.

Thus, there is a need for a cost-effective system for transmitting reverse data from a plurality of DICs to a TCON.

SUMMARY

According to an embodiment of the present invention there is provided a plurality of bidirectional display driver integrated circuits (DICs) connected in a chain, the chain having a beginning and an end, each of the plurality of DICs including: a direct data input; a relay data input; and a relay data output, each of the plurality of DICs being configured: to combine data received at the direct data input with a stream of bits received at the relay data input to form combined data, and to transmit the combined data through the relay data output.

In one embodiment, a first DIC of the plurality of DICs is at the beginning of the chain, and the relay data input of the first DIC is wired to receive a stream of bits at a first logic level.

In one embodiment, a first DIC of the plurality of DICs is configured to transmit, at the relay data output of the first DIC, a stream of data words, each data word having n bits, n being the number of DICs in the chain.

In one embodiment, the transmitting includes: for a first bit of each data word, retransmitting a bit received at the direct data input of the DIC; and for the remaining n−1 bits of each data word, retransmitting n−1 corresponding bits received at the relay data input of the DIC.

In one embodiment, the position within each data word of the first bit corresponds to a position of the first DIC within the chain.

In one embodiment, each of the plurality of DICs further includes a forward data input.

In one embodiment, each of the plurality of DICs further includes a reverse data clock and each of the plurality of DICs is configured to synchronize the reverse data clock of the DIC to a clock signal embedded in a forward data signal received at the forward data input of the DIC.

In one embodiment, each of the plurality of DICs is configured, at power-up, to: wait, when the stream of bits received at the relay data input is a stream of bits at a first logic level.

In one embodiment, the first logic level is logical one.

In one embodiment, each of the plurality of DICs is configured, at power-up, to: transmit a stream of data words, each data word having n bits, n being the number of DICs in the chain, a first bit of each data word being at a second logic level, and the remaining n−1 bits of each data word being at a third logic level, different from the second logic level, when the stream of bits received at the relay data input is a stream of bits at a fourth logic level, different from the first logic level.

In one embodiment, each of the plurality of DICs is configured, after waiting while the stream of bits received at the relay data input is a stream of bits at a first logic level and after the stream of bits received at the relay data input ceases to be a stream of bits at the first logic level, to: transmit, at the relay data output of the DIC, a stream of data words, n−1 bits of each data word being equal to corresponding bits received at the relay data input, and the remaining one bit of each data word being set to a second logic level different from the first logic level.

In one embodiment, the position within each data word of the one bit corresponds to a first bit position in the stream of bits received at the relay data input, the first bit position being adjacent to a transition in the stream of bits received at the relay data input.

In one embodiment, the second logic level is logical zero.

In one embodiment, all of the DICs are identical.

In one embodiment, the relay data input of each of the plurality of DICs is a serial data input.

In one embodiment, the relay data output of each of the plurality of DICs is a serial data output.

According to an embodiment of the present invention there is provided a display including: a display panel including a plurality of sensors; a timing controller (TCON); and a plurality of bidirectional display driver integrated circuits (DICs) connected in a chain, the chain having a beginning and an end, each of the plurality of DICs including: a direct data input connected to one of the plurality of sensors; a relay data input; and a relay data output, the relay data output of one of the plurality of DICs being connected to the TCON, each of the plurality of DICs being configured: to combine data received at the direct data input with a stream of bits received at the relay data input to form combined data, and to transmit the combined data through the relay data output.

In one embodiment, a first DIC of the plurality of DICs is configured to transmit, at the relay data output of the first DIC, a stream of data words, each data word having n bits, n being the number of DICs in the chain.

In one embodiment, the transmitting includes: for a first bit of each data word, retransmitting a bit received at direct data input of the DIC; and for the remaining n−1 bits of each data word, retransmitting n−1 corresponding bits received at the relay data input of the DIC.

According to an embodiment of the present invention there is provided a display including a timing controller (TCON) and a plurality of driver integrated circuits (DICs), each of the plurality of DICs including: a direct data input; a relay data input; a relay data output; and means for: combining data received at the direct data input with a stream of bits received at the relay data input to form combined data, and transmitting the combined data through the relay data output.

BRIEF DESCRIPTION OF THE DRAWINGS

These and other features and advantages of the present invention will be appreciated and understood with reference to the specification, claims, and appended drawings wherein:

DETAILED DESCRIPTION

The detailed description set forth below in connection with the appended drawings is intended as a description of exemplary embodiments of a relay-based bidirectional display interface provided in accordance with the present invention and is not intended to represent the only forms in which the present invention may be constructed or utilized. The description sets forth the features of the present invention in connection with the illustrated embodiments. It is to be understood, however, that the same or equivalent functions and structures may be accomplished by different embodiments that are also intended to be encompassed within the spirit and scope of the invention. As denoted elsewhere herein, like element numbers are intended to indicate like elements or features.

Figure 1:
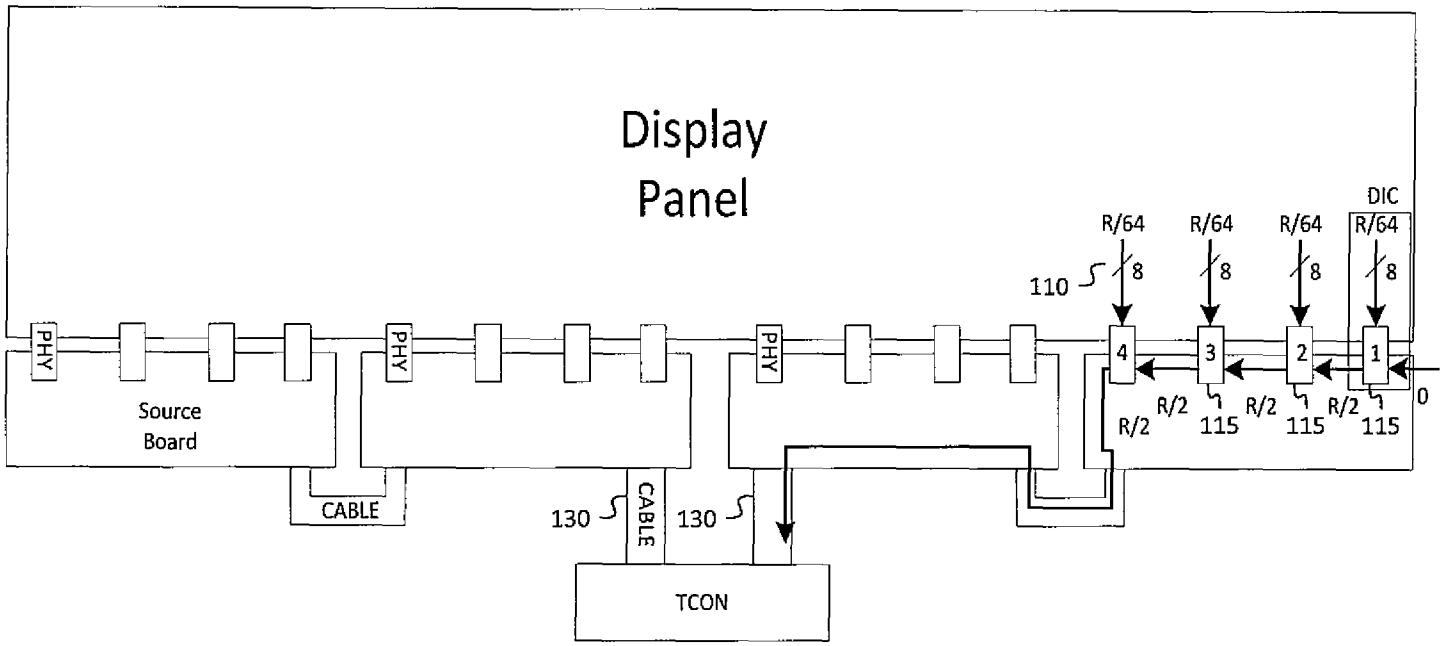
FIG. 1 is a block diagram of a display, according to an embodiment of the present invention.

Referring to FIG. 1, in one embodiment a plurality of DICs are chained together to form one or more relay chains with e.g., 4 DICs per relay chain. In this embodiment, reverse data flows on a plurality of 8 bit wide parallel busses 110 in the display panel, to a plurality of corresponding driver integrated circuits (DICs) 115.

In each relay chain, the first DIC in the relay chain (i.e., the DIC at the beginning of the chain) re-transmits the data it receives from the display panel to the next DIC in the relay chain. The second DIC in the chain then interleaves the data it receives from the display panel with the data it receives from the first DIC, and transmits the combined data stream to the third DIC in the chain. Similarly, every subsequent DIC in the chain interleaves the data it receives from the display panel with the data it receives from the preceding DIC in the chain, and transmits the combined data stream to the next DIC in the chain, or (if it is the last DIC in the chain, i.e., the DIC at the end of the relay chain), to the TCON. The reverse data received by a DIC directly from the display panel are referred to herein as "direct data", and the data each DIC (except the first DIC) receives from the DIC preceding it in the chain are referred to herein as "relay data".

For example, the four DICs numbered 1 through 4 in FIG. 1 (referred to herein as DIC1, DIC2, DIC3 and DIC4) are part of one relay chain. The DICs may be substantially identical integrated circuits, each having a serial input, a serial output, and a parallel input. Since DIC1 is on the end, the serial input of DIC1 is not connected to a data source. DIC1 receives direct data from the display panel, serializes it, and transmits it to DIC2. DIC2 receives, on its serial input, relay data from DIC1, and DIC2 also receives direct data from the display panel on its parallel input bus. DIC2 interleaves the (serialized) direct data from the display panel with the (serial) relay data it receives from DIC1, and transmits the combined (i.e., interleaved) data stream to DIC3. DIC3 then proceeds in a similar fashion, interleaving direct data it receives at its parallel input with the relay data it receives from DIC2 and transmitting it to DIC4, and DIC4 interleaves direct data it receives at its parallel input with the relay data it receives from DIC3, and transmits the combined data stream to the TCON.

In one embodiment, illustrated in FIG. 1, the TCON has two cables 130 through which it receives reverse data, from a left side of the display panel and from a right side of the display panel respectively. Each side of the display includes two source boards, each having 4 DICs. The DICs on each source board form a respective relay chain, so that there are two relay chains on the left side, transmitting data to the TCON through the left cable 130 and two relay chains on the right side, transmitting data to the TCON through the right cable 130. Each cable 130 may carry reverse data at a total data rate of R (measured, for example, in bits/second).

In the embodiment of FIG. 1, each of the 8 conductors in each of the parallel busses 110 transmits reverse data to a respective DIC 115 at a data rate of R/64, so that the total reverse data rate received through the parallel input by each DIC is R/8. The total reverse data rate from each source board is then R/4 and the total data from each side of the display (each having two source boards) is R/2.

As one of skill in the art will understand, the numbers and ratios shown in FIG. 1 are for purposes of illustration only, and may differ, in some embodiments, from those shown in FIG. 1. For example, the width of the data busses from the display panel need not be 8 but may be greater or smaller, and in one case the busses may have a width of 1 (i.e., they may be serial connections). Similarly, the connections along the chain, between DICs, need not be serial connections (i.e., busses of width 1) but may be parallel connections for transmitting more than 1 bit simultaneously. There may be more or fewer than four DICs per relay chain, and there may be more or fewer than four relay chains per TCON.

Figure 2:
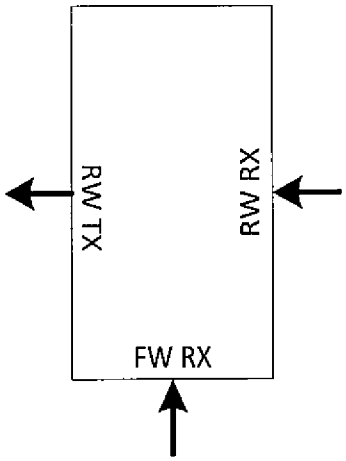
FIG. 2 is a block diagram of a DIC, according to an embodiment of the present invention.

Referring to FIG. 2, in one embodiment each DIC receives forward data at a forward data input (not shown in FIG. 1) referred to as FW RX. The forward data received at this input may be used as an "embedded clock" source, i.e., it may be used as a synchronization source from which to generate, in each DIC, a clock (or "reverse data clock") for transmitting relay data to the next DIC, or to the TCON. For example, referring to FIG. 3, in one embodiment a clock and data recovery (CDR) circuit in the DIC recovers the forward data clock (FL RX CLK) and it is divided, in a divider circuit 310, to form the local reverse data clock (or "physical layer" clock, or "PHY" clock) 320 for that DIC. The divider circuit may divide by an integer (using, e.g., a binary counter or a ring counter) or it may divide by a rational number (e.g., using a fractional phase-locked loop). In other embodiments the forward data clock may instead by multiplied by an integer or rational fraction (e.g., in a phase-locked loop, or fractional phase-locked loop) to form the reverse data clock, which may be at a higher frequency than the forward data clock.

In each DIC, the reverse data clock may be used to clock the transmitted data, in a reverse link transmitter (RL TX) 330. As the reverse data clocks in the DICs are all at the same frequency (since all forward links are connected to the same TCON), all the reverse link transmitters 330 in the display system are also at the same frequency, although they may be at different phases. For the $N^{th}$ DIC (which may be referred to as DIC(N)), the reverse link serial signal received from the $(N-1)^{th}$ DIC (which may be referred to as DIC(N−1)), is on the reverse data clock domain of DIC(N−1) plus a channel flight-time delay. To properly receive these data at DIC(N), the phase of the local reverse clock of DIC(N) may be calibrated, for example using a phase interpolator (PI) 335 and a phase calibration (PCAL) state-machine 340, so that the reverse link receiver (RL RX) 345 samples the incoming relay data at the center of the received eye. The sampled relay data then are passed to the internal reverse data clock (i.e., PHY clock) domain of the reverse data clock of DIC(N) where the data are time-multiplexed (e.g., interleaved) with the direct data received from the display panel (or "Data from DRV") and subsequently re-transmitted through reverse link transmitter port.

Figure 4:
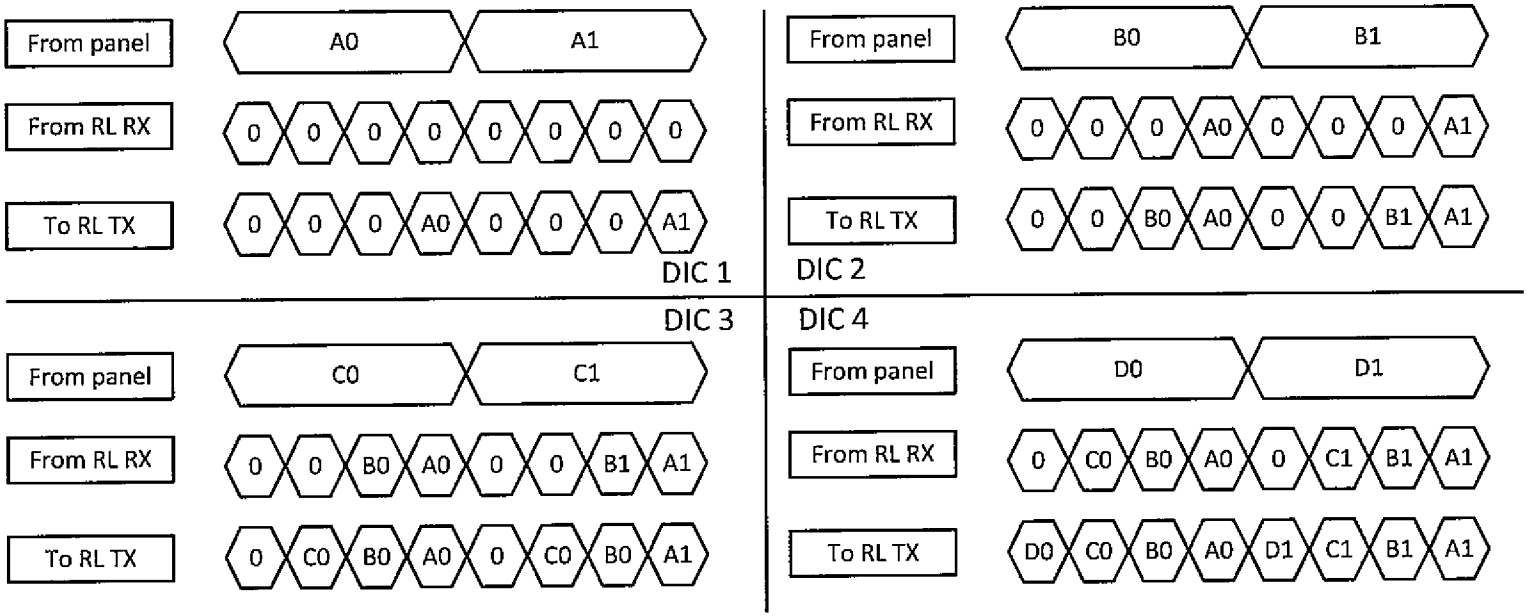
FIG. 4 is a timing diagram of four DICs in a relay chain, according to an embodiment of the present invention.

In the embodiment of FIG. 1, the reverse data pins RL TX and RL RX are capable of transmission and reception at a data rate of R/2. FIG. 4 shows the data patterns at the RL RX and RL TX pins for DIC1, DIC2, DIC3, and DIC4 in the relay chain. The reverse relay data includes (e.g., consists of) a stream of serial data words, with each data word containing one bit per DIC. Each DIC in the chain has a designated position index and places its data on the reverse link at that designated time-slot or position within the data word. For example, in the embodiment of FIG. 4, DIC1 places data in the fourth bit of each data word, DIC2 places data in the third bit of each data word, DIC3 places data in the second bit of each data word, and DIC4 places data in the first bit of each data word. The designated index is automatically detected by the DIC during the initialization sequence as described in further detail below.

Figure 3:
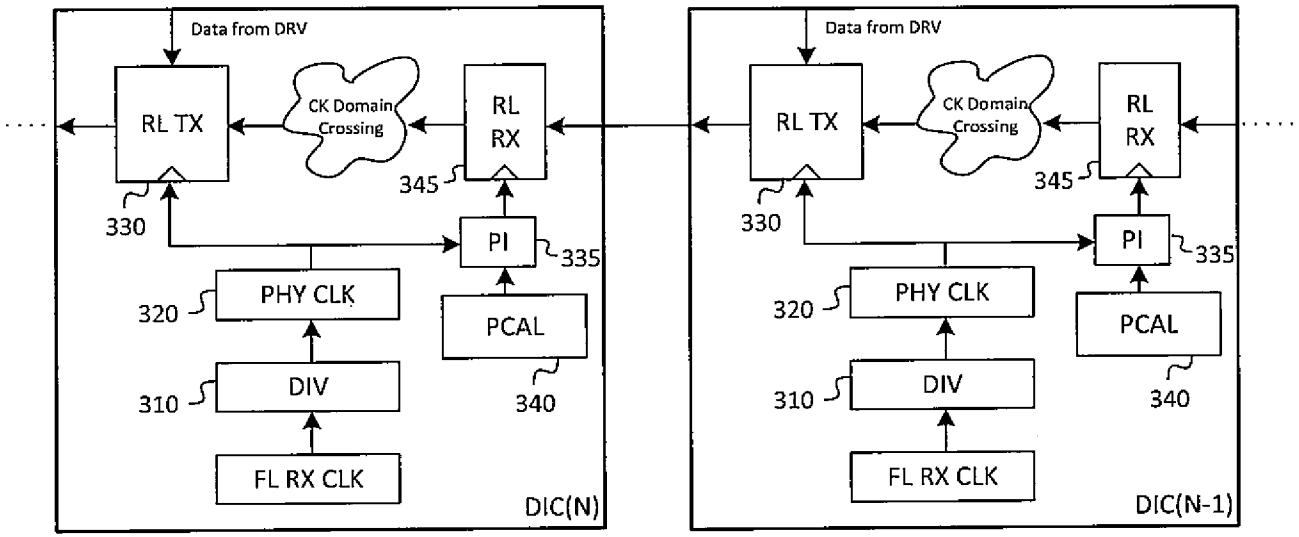
FIG. 3 is a block diagram of two DICs that form part of a relay chain, according to an embodiment of the present invention.
Figure 5:
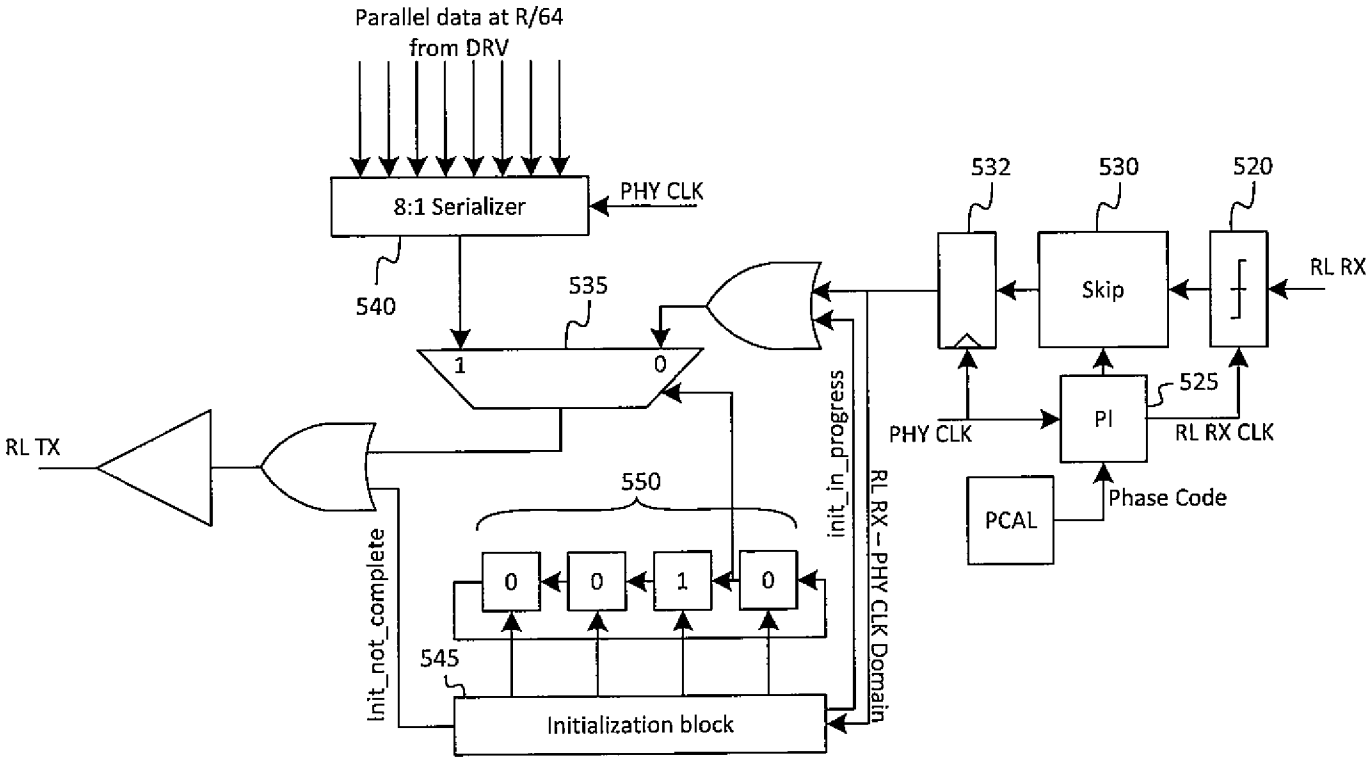
FIG. 5 is a block diagram of circuitry of a DIC, according to an embodiment of the present invention.

Referring to FIG. 5, before relay data transmission begins, the individual DIC circuits are initialized so that each DIC detects its position within the chain, so that it may subsequently use the corresponding time slot or bit position within each reverse data word. The DICs in the relay are initialized in order, from DIC1 to DIC4. Before initialization is completed by a particular DIC, the initialization state-machine (or "initialization block") 545 holds the RL TX output high (by asserting the init_not_complete signal in FIG. 5), i.e., it transmits a series of ones. The next DIC in the chain waits while it receives a stream of ones (i.e., while it receives a stream of bits at a first logic level, the first logic level being logical one) at its relay data input (RL RX). The RL RX input of DIC1 is connected (e.g., as a result of being hard-wired) to a voltage source, e.g., to logic low. As a result, at startup, DIC1 receives a constant stream of zeroes at its relay data input. This signals to DIC1 that it is the first DIC in the relay chain, and DIC1 starts the initialization process immediately (while the remaining DICs in the chain wait). DIC1 selects a position within the data word to allocate to itself, and then begins transmitting a stream of data words each of which has a zero at the allocated position, and the remainder of each of which is composed of ones. The selection of a position at this stage may be arbitrary. In the example of FIGS. 1, 4, and 5 (for an embodiment with 4 DICs in each relay chain), DIC1 then transmits a serial word with 3 ones and 1 zero, e.g., "1 1 1 0". In the embodiment of FIG. 5, when init_not_complete is high, the relay data output (RL TX) remains high regardless of the state of $int_{13}$in_progress. In other words, even though the reverse data is selected by the multiplexer (mux), it is masked by the OR gate at the output. In one embodiment, the output of the 8:1 serializer is forced to one while initialization is in progress. In another embodiment, the circuit of FIG. 5 is modified by moving the OR gate from input-0 to input-1 of the multiplexer. This way, while initialization of the DIC is not complete, the out OR forces RL TX to high, so that what goes inside the DIC doesn't disturb the output. After initialization is complete, RL TX is unmasked (init_not_complete is low), and then the ring counter may select between the 8:1 serializer output (which is forced to 1 since $int_{13}$in_progress is still high) and whatever gets into the DIC through RL RX. In operation, after initialization, the DIC combines data received at the direct data input (labeled "Parallel data at R/64 from DRV" in FIG. 5) with a stream of bits received at the relay data input (labelled "RL RX" in FIG. 5) to form combined data, and transmits the combined data through the relay data output (labelled "RL TX" in FIG. 5). In FIG. 3, the direct data input of each DIC is the input, to the reverse link transmitter 330, labeled "Data from DRV"; the relay data input is the data input of the reverse link receiver (RL RX) 345 (the data input being, in FIG. 3, the input on the right hand side of the reverse link receiver 345), and the relay data output is the output of the reverse link transmitter 330.

When the RL RX input of DIC2 changes from a stream of ones to a stream in which the pattern "1 1 1 0" repeats, the relay input of DIC2 undergoes two transitions (from low to high and then from high to low) per relay data word. DIC2 may then perform a phase calibration, under the control of the phase calibration (PCAL) state-machine, using one or both of the received transitions as a phase reference. For example, the phase calibration state-machine may gradually change the phase of the relay data receiver sampler 520 until the received data stream has one more or one fewer 1 (e.g., a pattern of "0 1 1 1 1 0" "0 1 1 0" is received) and then adjust the phase back by one-half cycle so that the sampling point is centered in the eye of the received relay data. In another embodiment, a clock and data recovery circuit which includes a crossing slicer (or "sampler" or "clocked comparator") that samples the received relay data 90 degrees out of phase with the data sampler, and provides continuous phase feedback control, may be used. In yet another embodiment, all of the DICs may be programmed to transmit alternating ones and zeros (i.e., a half-rate clock) for some period of time after startup, and each DIC in the chain, except the first, may perform a phase calibration during this period. Once the phase calibration time has elapsed, each DIC may begin transmitting a stream of ones until the remainder of the initialization sequence is complete.

When DIC1 transmits (and DIC2 receives) the pattern "1 1 1 0", this indicates to DIC2 (i) that the preceding DIC in the chain has completed its initialization, and (ii) where in the relay word its allocated bit position is. In the example of FIG. 4, this is the third bit of each data word. DIC2 then substitutes a 0 for the 1 at the position of the third bit (i.e., at the position in each relay word corresponding to its allocated bit position), and retransmits the data stream (now modified to "1 1 0 0", to the next DIC, i.e., to DIC3. Similarly DIC3 substitutes a 0 for the 1 at a position in each relay word corresponding to its allocated data position, and retransmits the data stream (now modified to "1 0 0 0"), to the next DIC, i.e., to DIC4.

Because the time of flight of the signal between DICs may not be an integer multiple of the relay data clock period, the circuit within each DIC may operate in two clock domains, one being a clock with a phase adjusted to receive the relay data from the preceding DIC in the relay chain, and the other being the local reverse data clock formed from the forward data clock embedded in the forward data. If the relay data clock is formed by dividing the forward data clock by an integer, then it may be synchronized in phase to the forward data clock. The clock domains may be bridged, for example, by a depth-one first-in-first-out (FIFO) circuit.

Referring to FIG. 5, in one embodiment, each DIC includes the circuitry shown. A relay data receiver sampler 520 samples the received data with a phase-shifted clock formed by the phase interpolator 525. A circuit for bridging clock domains (or "skip" circuit) 530 transmits the received relay data to a flip flop 532. A multiplexer 535 selects, for the output relay data stream, either received relay data or received direct data (from a serializer 540 connected to the parallel bus). While the initialization is in progress, the signal init_in_progress, and the signal init_not_complete remain high, causing the DIC to transmit a stream of ones at the RL TX output.

The initialization block 545 receives the received relay data stream. When it detects a pattern including one or more zeros (i.e., the DIC is no longer receiving a stream of ones because the preceding DIC has completed its initialization), it identifies the slot allocated to the DIC being initialized, it initializes a circular shift register 550 with a one, and, e.g., 3 zeros (as illustrated in FIG. 5), with the one at a position in the shift register 550 corresponding to the bit position allocated to the DIC (e.g., the bit position preceding the one in which the DIC is receiving the first zero in the received relay data words). The total length of the shift register may be the number of DICs in the relay chain, i.e., the number of DICs sharing the same reverse lane. In operation, the circulating one in the circular shift register 550 switches the multiplexer 535 during one bit per data word, so that during that bit, a bit of the serialized direct reverse data is inserted in the relay data stream being transmitted.

Once the circular shift register 550 is initialized, and for the remainder of the initialization time period, the DIC transmits a zero in its allocated bit position (this functionality is not shown in FIG. 5).

Figure 6:
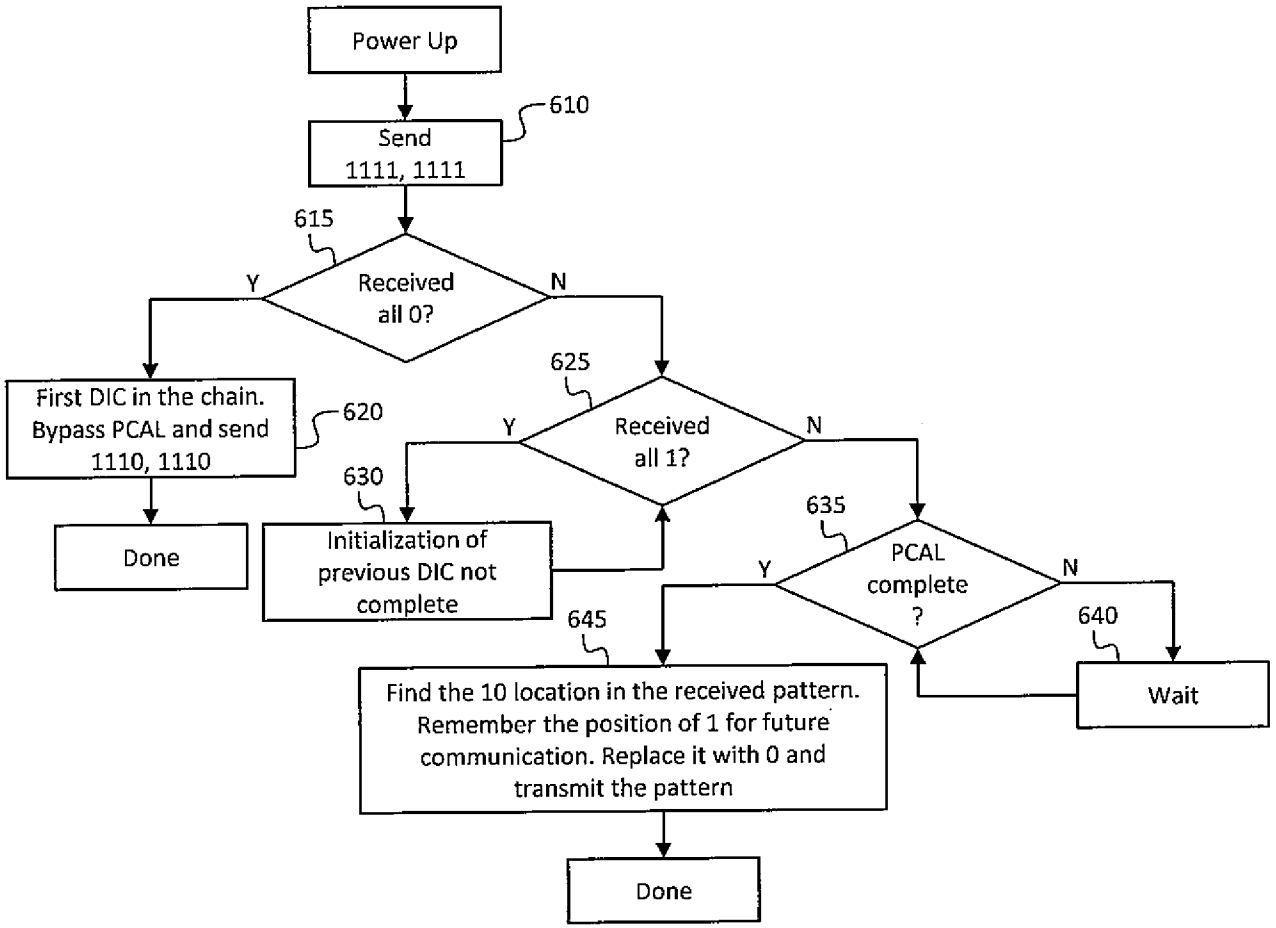
FIG. 6 is a flow chart of an initialization sequence, according to an embodiment of the present invention.

Referring to FIG. 6, in one embodiment the initialization sequence of each DIC proceeds as shown. After power-up, the DIC transmits, in an act 610, a stream of ones, so that the next DIC in the chain will wait. If the DIC determines, in an act 615, that is receiving a stream of zeros, then it is the first DIC in the chain, and, in an act 620, it bypasses the phase calibration process and, e.g., leaves the phase interpolator set to a default setting. It then begins to transmit the relay data word "1 1 1 0", where the zero represents the bit position allocated to DIC1.

If the DIC determines, in act 615, that is not receiving a stream of zeros, then it determines, in an act 625 whether it is receiving a stream of ones, and if so, it waits, in an act 630 as long as this condition continues (i.e., while the preceding DIC completes its initialization). Once it is no longer receiving a stream of ones, it determines, in an act 635, whether its phase calibration (which begins as soon as transitions are received at RL RX) is complete, and waits, in an act 640, until its phase calibration is complete. It then finds, in an act 645, the "10" transition in the received relay data, remembers (e.g., by suitable initialization of the circular shift register 550) the location of the one (of the bit pair "10"), replaces it with zero in the pattern, and retransmits the modified pattern at its RL TX output.

Each DIC may start a timer at power-up, and, after a suitable amount of time has elapsed, insuring that all DICs in the chain have had time to complete the initialization process, it may begin transmitting relay data.

As one of skill in the art will understand, certain aspects of implementation may be changed from those of the exemplary embodiments described herein, without changing the principle of operation of embodiments of the present invention. For example, the bit values of zero and one may be reversed in various combinations. For example, the relay data input of DIC1 may be hard-wired to one instead of to zero, and DIC1 may, after detecting that it is receiving a stream of ones, begin transmitting the pattern "0 0 0 1" instead of "1 1 1 0". As another example, each DIC in the chain after the first DIC need not allocate to itself a bit position immediately adjacent to a bit position allocated to the preceding DIC in the chain, but may allocate to itself any bit position not already allocated to a DIC.

Each DIC may be configured by one or more of various methods with information about the system. Such information be hard-wired in the chip (i.e., made part of the permanent wiring of the chip at fabrication), stored in firmware (e.g., in nonvolatile write-once or re-writable memory on the chip), stored in volatile memory (e.g., written to one or more registers in the DIC after power-up), hard-wired into a printed circuit board onto which the chip is installed, or discovered by the DIC after power-up during initialization. For example, as described, each DIC may discover its position in the relay chain during initialization. As another example, wiring on a printed circuit board may, as described above, identify the first DIC in the relay chain. Similarly, each DIC may be configured by one of the above methods with information about the number of DICs in the chain (which the DIC may discover from the length of the bit sequence it receives during initialization). The ratio of the forward data clock to the reverse data clock may be programmed into one or more registers in the DIC, or hard-wired in the DIC.

Figure 7:
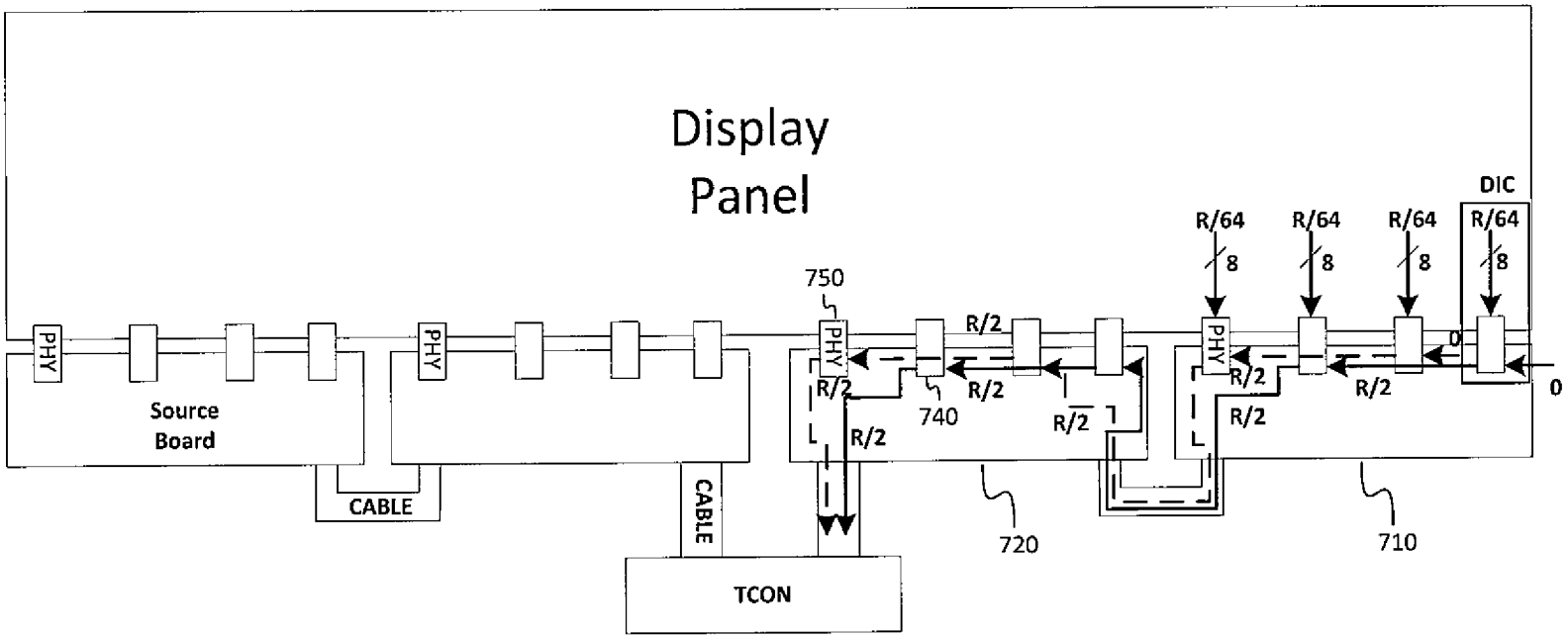
FIG. 7 is a block diagram of a display according to an embodiment of the present invention.

In the configuration of FIG. 1, the last DIC in the right-most relay chain drives an input of the TCON through two cables (the cable between the source boards and the cable between one of source boards and the TCON) as well as a relatively long trace on the source board between the TCON and the right-most relay chain. This may constrain the design of the DIC circuitry and increase cost. In some embodiments, the need to drive such a long transmission line may be avoided. For example, referring to FIG. 7, in one embodiment a relay chain may not consist simply of the DICs on one source board. In the embodiment of FIG. 7, a first source board 710 and a second source board 720 are both on the right side of a display, and connected to a TCON. The first source board 710 is more distant from the TCON. The two DICs 740, 750 nearest the TCON are the last DICs in two respective relay chains. Each of the last DICs in the two respective relay chains drives an input on the TCON through only a relatively short trace on the second source board 720, and through the cable between the second source board 720 and the TCON. The remaining DICs in each of the relay chains may for example be alternating DICs as shown in FIG. 7.

Figure 8:
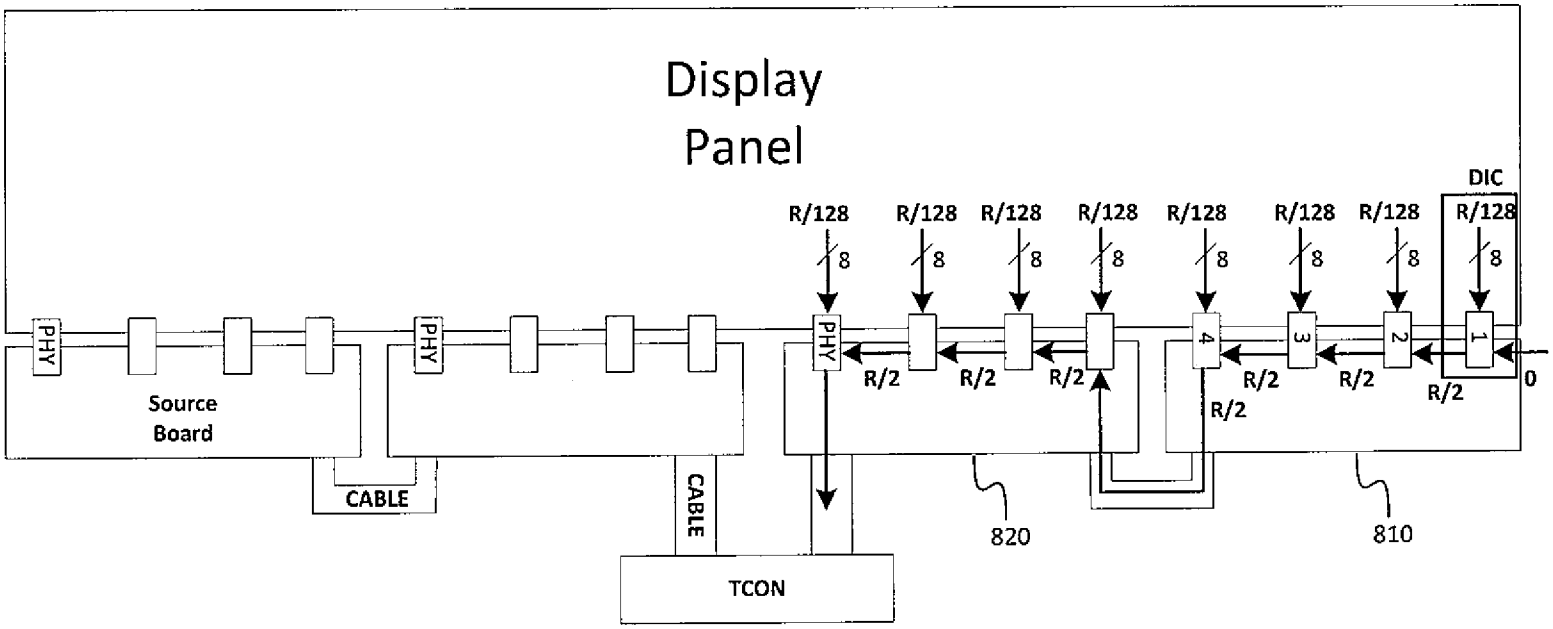
FIG. 8 is a block diagram of a display according to an embodiment of the present invention.

In another embodiment illustrated in FIG. 8, a relay chain includes 8 DICs, four on each of two source boards 810, 820. The last DIC on the first source board is followed by the first DIC on the second source board. The data rate on each of the wires of each of several 8-bit-wide parallel buses is R/128, so that the total reverse data rate from the right side of the display is R/2.

Embodiments of the present invention have various features and benefits. In some embodiments, since the clocks of all DICs are frequency locked to the TCON clock (i.e., the forward data clock) through the forward link, no frequency acquisition may be necessary for the reverse link. Only phase acquisition may be performed, through a phase calibration (PCAL) algorithm, utilizing a phase-interpolator and a state machine to center the reverse link receiver data eye with respect to the DIC clock derived from the forward link, which is in turn derived from the TCON clock.

In some embodiments all DIC-to-DIC reverse links are short and point-to-point, and the RL RX can be a simple and low-power receiver. As mentioned above, a simple circular shift register that circulates a "1" level can be used to multiplex between relay data from RL RX and direct data from DRV. As a result of the data relay, the final DIC in the chain (e.g., DIC4) is physically closer to the TCON, and the reverse relay data rate may be R/2 (or lower depending on the embodiment and the desired reverse data rate per DIC). Therefore, the signal quality in the reverse link may be higher between the final DIC in the chain and the TCON (than the signal quality, for example, in the forward link), leading to simpler circuit designs compared to the forward link. In some embodiments, the RL TX is designed using voltage-mode drivers so that it only consumes power during data transitions, lowering the system power consumption compared to other approaches.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section, without departing from the spirit and scope of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that such spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the terms "substantially," "about," and similar terms are used as terms of approximation and not as terms of degree, and are intended to account for the inherent deviations in measured or calculated values that would be recognized by those of ordinary skill in the art. As used herein, the term "major component" means a component constituting at least half, by weight, of a composition, and the term "major portion", when applied to a plurality of items, means at least half of the items.

As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the present invention". Also, the term "exemplary" is intended to refer to an example or illustration. As used herein, the terms "use," "using," and "used" may be considered synonymous with the terms "utilize," "utilizing," and "utilized," respectively.

It will be understood that when an element or layer is referred to as being "on", "connected to", "coupled to", or "adjacent to" another element or layer, it may be directly on, connected to, coupled to, or adjacent to the other element or layer, or one or more intervening elements or layers may be present. In contrast, when an element or layer is referred to as being "directly on", "directly connected to", "directly coupled to", or "immediately adjacent to" another element or layer, there are no intervening elements or layers present.

The electronic or electric devices and/or any other relevant devices or components of a display according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Although exemplary embodiments of a relay-based bidirectional display interface have been specifically described and illustrated herein, many modifications and variations will be apparent to those skilled in the art. Accordingly, it is to be understood that a relay-based bidirectional display interface constructed according to principles of this invention may be embodied other than as specifically described herein. The invention is also defined in the following, claims, and equivalents thereof.

What is claimed is:

1. A plurality of bidirectional display driver integrated circuits (DICs) connected in a chain, the chain having a beginning and an end, each of the plurality of DICs comprising:

a direct data input;

a relay data input; and a relay data output, each of the plurality of DICs satisfying:

the relay data output of the DIC being connected to the relay data input of an adjacent DIC in the chain, and the relay data input of the DIC being connected to the relay data output of another adjacent DIC in the chain, or the relay data output of the DIC being connected to the relay data input of an adjacent DIC in the chain, or the relay data input of the DIC being connected to the relay data output of an adjacent DIC in the chain, each of the plurality of DICs being configured:

to combine data received at the direct data input with a stream of bits received at the relay data input to form combined data, and to transmit the combined data through the relay data output.

2. The chain of claim 1, wherein a first DIC of the plurality of DICs is at the beginning of the chain, and the relay data input of the first DIC is wired to receive a stream of bits at a first logic level.

3. The chain of claim 1, wherein a first DIC of the plurality of DICs is configured to transmit, at the relay data output of the first DIC, a stream of data words, each data word having n bits, n being the number of DICs in the chain.

4. The chain of claim 3, wherein the transmitting comprises:

for a first bit of each data word, retransmitting a bit received at the direct data input of the DIC; and for the remaining n−1 bits of each data word, retransmitting n−1 corresponding bits received at the relay data input of the DIC.

5. The chain of claim 4, wherein the position within each data word of the first bit corresponds to a position of the first DIC within the chain.

6. The chain of claim 1, wherein each of the plurality of DICs further comprises a forward data input.

7. The chain of claim 6, wherein each of the plurality of DICs further comprises a reverse data clock and each of the plurality of DICs is configured to synchronize the reverse data clock of the DIC to a clock signal embedded in a forward data signal received at the forward data input of the DIC.

8. The chain of claim 1, wherein each of the plurality of DICs is configured, at power-up, to:

wait, when the stream of bits received at the relay data input is a stream of bits at a first logic level.

9. The chain of claim 8, wherein the first logic level is logical one.

10. The chain of claim 8, wherein each of the plurality of DICs is configured, at power-up, to:

transmit a stream of data words, each data word having n bits, n being the number of DICs in the chain, a first bit of each data word being at a second logic level, and the remaining n−1 bits of each data word being at a third logic level, different from the second logic level, when the stream of bits received at the relay data input is a stream of bits at a fourth logic level, different from the first logic level.

11. The chain of claim 8, wherein each of the plurality of DICs is configured, after waiting while the stream of bits received at the relay data input is a stream of bits at a first logic level and after the stream of bits received at the relay data input ceases to be a stream of bits at the first logic level, to:

transmit, at the relay data output of the DIC, a stream of data words, n−1 bits of each data word being equal to corresponding bits received at the relay data input, and the remaining one bit of each data word being set to a second logic level different from the first logic level.

12. The chain of claim 11, wherein the position within each data word of the one bit corresponds to a first bit position in the stream of bits received at the relay data input, the first bit position being adjacent to a transition in the stream of bits received at the relay data input.

13. The chain of claim 11, wherein the second logic level is logical zero.

14. The chain of claim 1, wherein all of the DICs are identical.

15. The chain of claim 1, wherein the relay data input of each of the plurality of DICs is a serial data input.

16. The chain of claim 1, wherein the relay data output of each of the plurality of DICs is a serial data output.

17. A display comprising:

a display panel comprising a plurality of sensors;

a timing controller (TCON); and a plurality of bidirectional display driver integrated circuits (DICs) connected in a chain, the chain having a beginning and an end, each of the plurality of DICs comprising:

a direct data input connected to one of the plurality of sensors;

a relay data input; and a relay data output, each of the plurality of DICs satisfying:

the relay data output of the DIC being connected to the relay data input of an adjacent DIC in the chain, and the relay data input of the DIC being connected to the relay data output of another adjacent DIC in the chain, or the relay data output of the DIC being connected to the relay data input of an adjacent DIC in the chain, or the relay data input of the DIC being connected to the relay data output of an adjacent DIC in the chain, the relay data output of one of the plurality of DICs being connected to the TCON, each of the plurality of DICs being configured:

to combine data received at the direct data input with a stream of bits received at the relay data input to form combined data, and to transmit the combined data through the relay data output.

18. The display of claim 17, wherein a first DIC of the plurality of DICs is configured to transmit, at the relay data output of the first DIC, a stream of data words, each data word having n bits, n being the number of DICs in the chain.

19. The chain of claim 18, wherein the transmitting comprises:

for a first bit of each data word, retransmitting a bit received at direct data input of the DIC; and for the remaining n−1 bits of each data word, retransmitting n−1 corresponding bits received at the relay data input of the DIC.

20. A display comprising a timing controller (TCON) and a plurality of driver integrated circuits (DICs), each of the plurality of DICs comprising:

a direct data input;

a relay data input;

a relay data output; and means for:

combining data received at the direct data input with a stream of bits received at the relay data input to form combined data, and transmitting the combined data through the relay data output, each of the plurality of DICs satisfying:

the relay data output of the DIC being connected to the relay data input of an adjacent DIC in the chain, and the relay data input of the DIC being connected to the relay data output of another adjacent DIC in the chain, or the relay data output of the DIC being connected to the relay data input of an adjacent DIC in the chain, or the relay data input of the DIC being connected to the relay data output of an adjacent DIC in the chain.

* * * * *